US008201430B1

(12) United States Patent
Frear

(10) Patent No.: US 8,201,430 B1
(45) Date of Patent: Jun. 19, 2012

(54) HYDRAULIC REBAR BENDER CUTTER ATTACHMENT FOR SKID-STEER LOADER

(76) Inventor: Robert Frear, North Redington Beach, FL (US)

( * ) Notice: Subject to any disclaimer, the term of this patent is extended or adjusted under 35 U.S.C. 154(b) by 961 days.

(21) Appl. No.: 12/157,433

(22) Filed: Jun. 10, 2008

Related U.S. Application Data

(60) Provisional application No. 60/937,140, filed on Jun. 27, 2007.

(51) Int. Cl.
*B21D 7/02* (2006.01)
*B21D 7/022* (2006.01)

(52) U.S. Cl. ..... 72/217; 72/216; 72/387

(58) Field of Classification Search ..... 72/128–132, 72/307, 387, 457, 705, 453.18
See application file for complete search history.

(56) References Cited

U.S. PATENT DOCUMENTS

| | | | | |
|---|---|---|---|---|
| 3,680,347 | A * | 8/1972 | Schenck et al. | 72/217 |
| 3,891,187 | A * | 6/1975 | Bearden, Jr. | 72/705 |
| 4,561,279 | A | 12/1985 | Wears | |
| 4,945,751 | A | 8/1990 | Ireland | |
| 5,129,246 | A * | 7/1992 | Strickland et al. | 72/449 |
| 5,144,829 | A | 9/1992 | Fabro et al. | |
| 5,203,192 | A * | 4/1993 | Kimura | 72/217 |
| 5,791,820 | A * | 8/1998 | Rempel | 405/232 |
| 5,878,615 | A | 3/1999 | Brown | |
| 5,931,039 | A * | 8/1999 | Yoshimizu et al. | 72/217 |
| 6,030,169 | A * | 2/2000 | Rossow et al. | 414/680 |
| 6,230,535 | B1 * | 5/2001 | Benes et al. | 72/306 |
| 6,418,773 | B1 | 7/2002 | Tolman | |
| 6,993,950 | B2 | 2/2006 | Bryan | |

FOREIGN PATENT DOCUMENTS

EP 123231 A1 * 10/1984 ..... 72/217

OTHER PUBLICATIONS www.taeyeon.co.kr/neg/product/productl.asp?codel =2&product_ num=10007 (as viewed on wayback machine).*
www.taeyeon.co.kr/neg/product/product1.asp?code1=2&product_ num=10007 copyright date 2005.
Mittler Bros. Machine and Tool 2008 Catalog p. 10, 10 Cooperative Way Wright City, Missouri 63390, published 2008.
Mittler Bros. Machine and Tool 2008 Catalog p. 10, 10 Cooperative Way Wright City, Missouri 63390.

* cited by examiner

*Primary Examiner* — Edward Tolan
*Assistant Examiner* — Pradeep C Battula
(74) *Attorney, Agent, or Firm* — Larson & Larson, P.A.; Frank Liebenow; Justin Miller

(57) ABSTRACT

A hydraulically rebar bender for skid-steer loader includes a structural case with quick-attach flanges for attachment to skid-steer loaders. The case has an adjustable work tray mounted on the face for supporting the rebar when bending. One end of a hydraulic cylinder is connected to the case and a distal end is connected to a rack gear. The rack gear mates with a pinion gear that is mounted on an axle. The pinion gear is connected to a bending disc that rotates with the pinion gear. A force shaft is mounted on the bending disk. The force shaft travels in a circular cutout of the case and accepts various size mandrels. The axle protrudes out of the case and has a bend mandrel mounted thereon. Hydraulic power is supplied by the skid-steer loaders hydraulic system via hydraulic supply hoses.

18 Claims, 5 Drawing Sheets

HYDRAULIC REBAR BENDER CUTTER ATTACHMENT FOR SKID-STEER LOADER

CROSS-REFERENCE TO RELATED APPLICATIONS

This application claims the benefit of U.S. provisional patent application Ser. No. 60/937,140 filed 2007 Jun. 27 by present inventor.

FEDERALLY SPONSORED RESEARCH

Not Applicable

SEQUENCE LISTING OR PROGRAM

Not Applicable

BACKGROUND OF INVENTION

1. Field of Invention

This invention generally relates to the bending and forming of metal rods and bars, especially concrete reinforcement bars (rebar) at a construction job site.

2. Prior Art

Concrete reinforcement bar, hereafter referred to as rebar, has been used in construction for many years. Rebar is produced in straight pieces of varying lengths, sometimes up to 40 feet. Rebar needs to be bent before being placed for various reasons such as foundation corners, column "cages" and the like. Until recently, job site bending and cutting was done with a manual tool or machine such as the one invented by Tolman, U.S. Pat. No. 6,418,773 B1. Currently there are several attempts at providing a means to bend and cut rebar on the job site, these include table mounted electrically powered machines, trailer mounted hydraulic and electrically powered machines, small handheld machines, and one known loader mounted hydraulically powered machine invented by Brown, U.S. Pat. No. 5,878,615.

Because of the extreme weight and awkwardness of rebar and the normally rough job site terrain, table top machines are not stable enough to efficiently perform. Handheld machines are not designed for larger size rebar or production bending and cutting. Both table top and handheld machines require either electrical power, a external hydraulic power source, or both. Trailer towed machines lack the ability to access areas that skid steer loaders do either for job site space constraints or terrain features.

Because of their great power, all-terrain ability and the versatility of quickly adding and changing a variety of attachments, skid-steer loaders have become common in the construction industry. Most skid-steer loaders are manufactured with hydraulic connections at the end of the lift arms enabling attachments that require hydraulic power to be used. This all-terrain hydraulic power source coupled with the stable work platform provided by the loaders heavy weight and low profile make my hydraulic rebar bender cutter attachment for skid-steer loader the preferred tool for jobsite metal bending and cutting.

Browns device though capable of being attached to a loader vehicle lacks the ability to bend beyond approximately 90 degrees. This is a major limitation since bends of up to 180 degrees are common in the industry. Additionally, although he claims his invention requires only one hydraulic cylinder to perform, it actually has two separate hydraulic cylinders with an accompanied sequencing valve, complicating the process. Therefore a need remains for a simple, reliable, loader mounted rebar bending and cutting attachment that is capable of production bends of up to 180 degrees without repositioning the rebar.

SUMMARY

In accordance with one embodiment, a rebar bender cutter machine that is:

(A) Hydraulically powered.
(B) Capable of bending up to 180 degrees without repositioning the rebar.
(C) Capable of cutting metal rods and bars.
(D) Capable of attaching to a skid-steer loaders standard quick-attach mounts.
(E) Gear driven.
(F) Durable and reliable.
(G) Efficient to build.

These and other objectives will be achieved by providing a device in the preferred embodiment with a rack and pinion gear system. One end of the rack is connected to a hydraulic cylinder that is actuated by an actuating means. The other end of said hydraulic cylinder is mounted to the machines case, which is an integral frame and housing for the components. The rack gear travels laterally in a slide channel. The rack gear is mated to a pinion gear that rotates freely on a fixed axel. A small portion of said fixed axel protrudes through the front of said case and acts as a bend shaft for mounting a bend mandrel. The opposite end of said fixed axel is mounted in an axle flange on the back case cover. Because different size rebar require different size bends, there is an assortment of mandrel sizes to accommodate industry standard minimum bend radii.

Attached to the pinion gear is a larger round bending disc. The bending disc rotates freely on said fixed axel and in unison with the pinion gear. Attached toward the outer edge and perpendicular to the face plane of the bending disc is a force shaft. The force shaft is a short axel that accepts a mandrel. The force shaft is of the same diameter as the bend shaft so as to allow the mandrels to be interchanged. The force shaft protrudes through the front of the case and travels in circular cutout. Attached to the front of the case is an adjustable work tray for supporting and positioning the rebar during bending. The work tray can be raised or lowered to the proper position to accommodate the different size mandrels and rebar.

Attached to the end of the rack gear opposite of the end of the hydraulic ram attachment is a cutter blade. When the hydraulic ram is fully extended the cutter blade attached to the rack gear contacts another cutter blade mounted on the far end of the slide channel. The case provides protection for the cutting blades. A U-shaped channel is cut out of the case perpendicular to the cutting blades linear travel. This channel is referred to as the "cutting-zone". When a piece of rebar is inserted into the cutting zone and the machine is activated the rebar will be cut when the hydraulic ram reaches its full length of travel and the cutter blades meet.

To bend, install the proper size mandrel on the bend shaft and the force shaft. Set the work tray to the proper height. Place the rebar on said work tray. Position the rebar laterally so as the desired bend point is under the bend mandrel. When the machine is activated, hydraulic power from the skid-steer loader causes the hydraulic ram to extend, further causing the rack gear to move in parallel with the hydraulic ram. The rack gear causes the pinion gear and the bending disc to rotate causing the rebar to bend.

Mounted on the back of the case are industry standard attachment flanges for skid-steer loaders. The attachment flanges are commonly referred to as quick-attach flanges.

Mounted on the bottom of the case are two U-channels that will accept fork lift style forks. The U-channels also act as feet to keep the machine off the ground when not attached to the skid-steer loader.

DRAWINGS

Figures

| DRAWINGS—REFERENCE NUMBERALS | |
|---|---|
| 11 | Rebar |
| 12 | Fixed Axle |
| 13 | Bend Mandrel |
| 14 | Retaining Washers |
| 15 | Retaining Bolt |
| 16 | Force Mandrel |
| 17 | Circular Cut-out |
| 18 | Cutting Zone |
| 19 | Work Tray |
| 20 | Adjustment Bolt |
| 21 | Fork Channels |
| 22 | Case |
| 23 | Hydraulic Cylinder |
| 24 | Hydraulic Manifold |
| 25 | Hydraulic Ram |
| 26 | Slide-Bar Rack Gear Assembly |
| 27 | Bending Disc |
| 28 | Pinion Gear |
| 29 | Cutter Blades |
| 30 | Slide Channel |
| 31 | Quick Attach Flanges |
| 32 | Hydraulic Supply Hoses |
| 33 | Force Shaft |
| 34 | Adjustment Holes |
| 35 | Adjustment Pins |
| 36 | Control Switch |
| 37 | Adjustment Knob |
| 38 | Control Switch Receptacle |
| 39 | Power Supply Cord |
| 40 | Bend Shaft |
| 41 | Hydraulic Control Valve |
| 42 | Axle Flange |
| 43 | Adjustment Slot |

DETAILED DESCRIPTION

Figure 1:
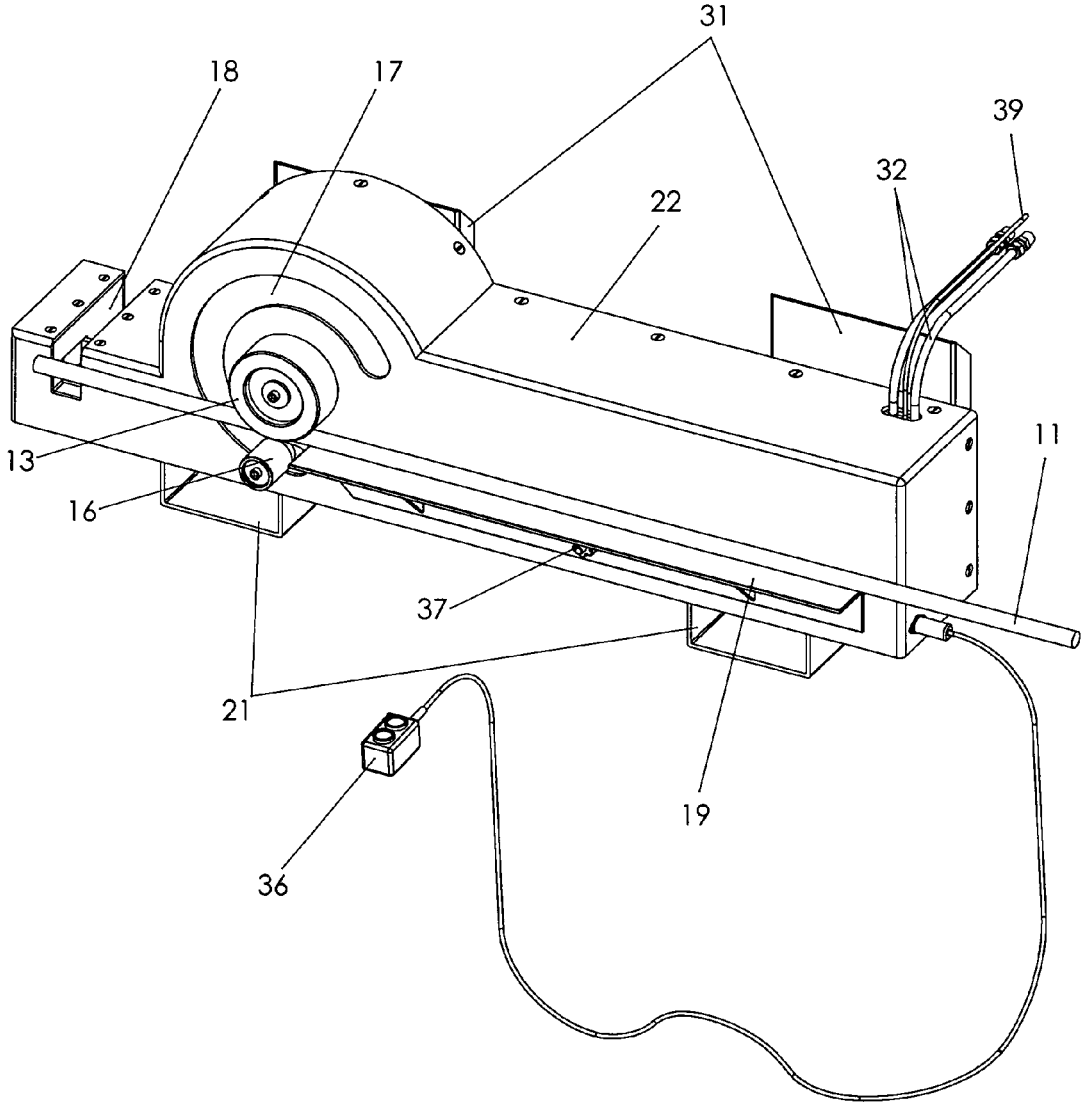
FIG. 1 is an isometric front view with the control switch attached. A piece of rebar is inserted and ready to bend.
Figure 2:
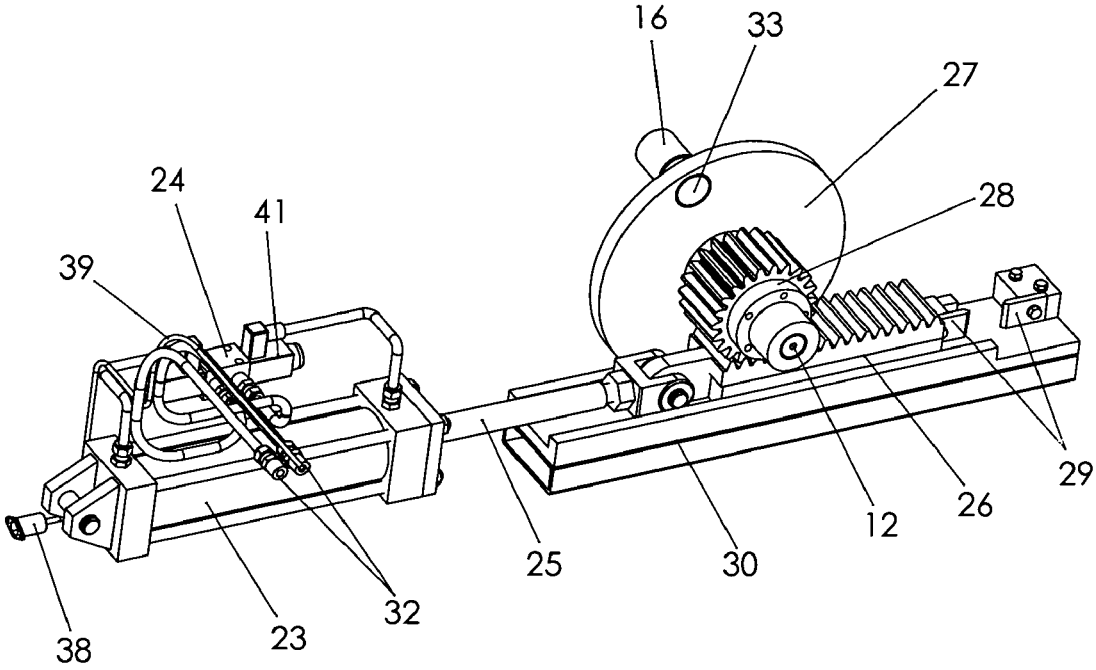
FIG. 2 is an isometric back view with the case, rear cover, work tray and quick-attach flanges removed for better viewing of the internal parts.
Figure 3:
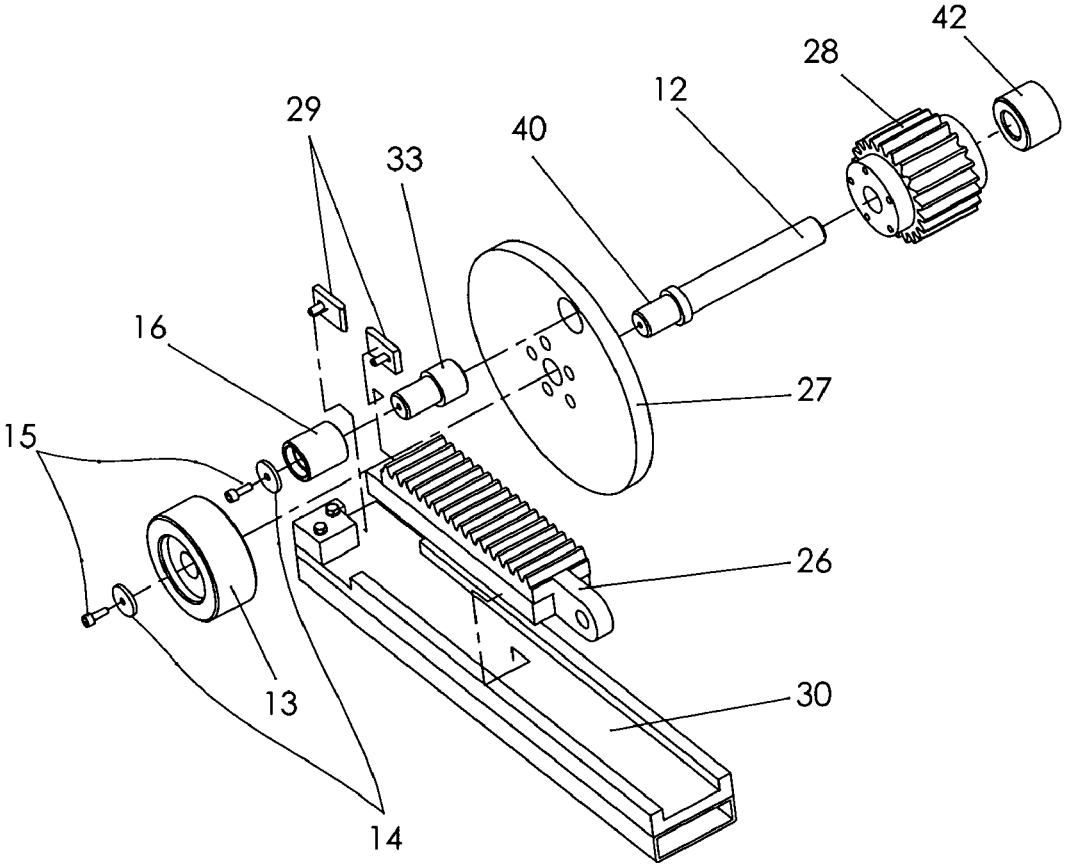
FIG. 3 is an exploded view of the internal parts. For clarity the case, rear cover, work tray, quick-attach flanges, electrical and hydraulics are not displayed.
Figure 8:
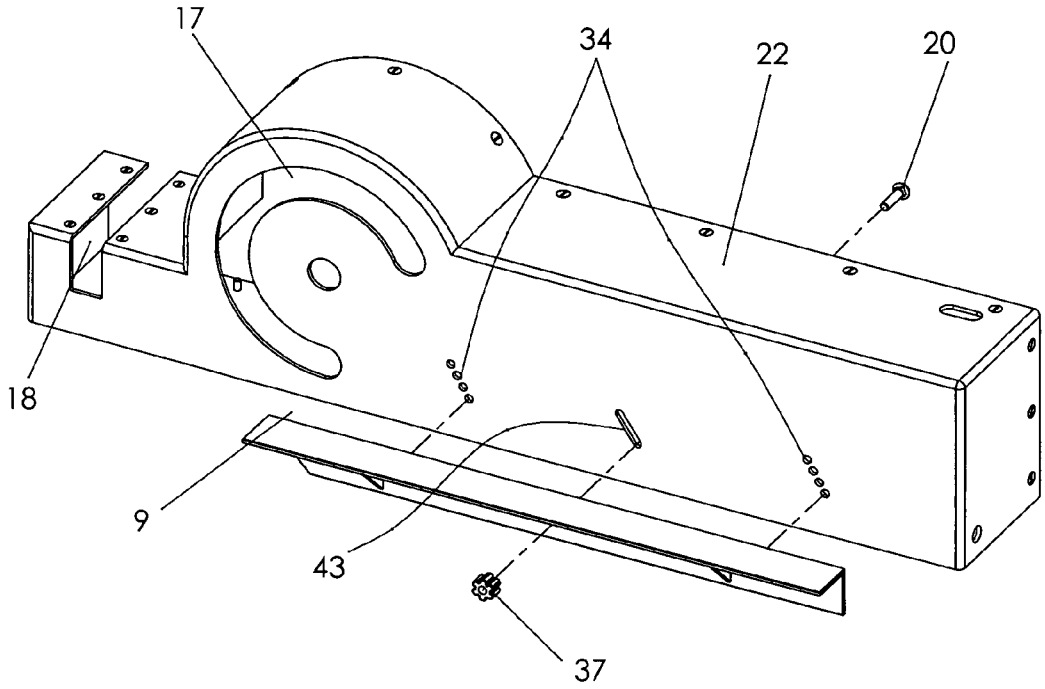
FIG. 8 shows an exploded view of the case and work tray components.
Figure 9:
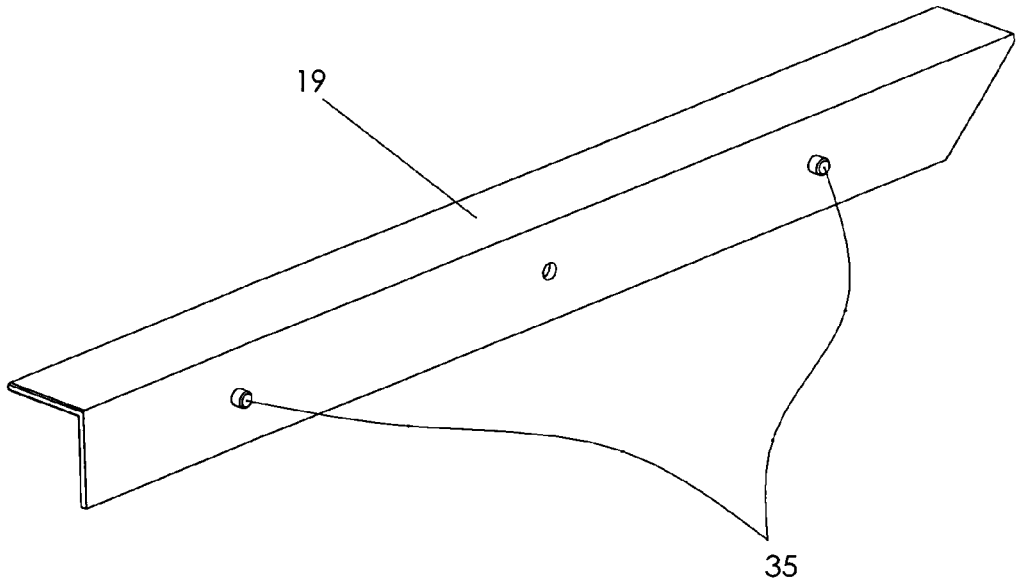
FIG. 9 shows a rear isometric view of the work tray for viewing of the adjustment pins.

Preferred Embodiment—FIGS. 1, 2, 3, 8, 9

The primary purpose of this machine is to bend and cut concrete reinforcement bar commonly known as "Rebar". For the purpose of these specifications and this preferred embodiment the term "Rebar" will be used throughout. This is not to limit the scope to only rebar since the machines design favors bending any kind of plastically deformable material that is elongated in shape. In addition, the preferred embodiment of the machine is to be mounted and hydraulically powered by a "skid-steer" loader vehicle. For the purposes of these specifications the term "skid-steer" will be used throughout. This is not to limit the scope of the machine to skid-steer loaders since by design it is capable of being mounted and powered by any type of loader vehicle with a hydraulic power source of sufficient output to operate the machine, such as backhoes, tractors, articulating loaders, forklifts and the like.

The machine is comprised of a hydraulic cylinder 23 attached to a case 22 on the cylinder end, and to a rack gear slide-bar assembly 26 on the hydraulic ram 25 end. The slide-bar rack gear assembly 26 travels laterally through a slide channel 30. The purpose of the slide channel 30 is to guide the slide-bar rack gear assembly 26 as it travels back and forth. A pinion gear 28 is free mounted on a fixed axel 12 in such a manner that it engages the slide-bar rack gear assembly 26. When the hydraulic cylinder 23 is powered the slide-bar rack gear assembly 26 moves laterally causing the pinion gear 18 to turn proportionally. A bending disc 27 is connected to the pinion gear 28 and mounted on the common fixed axel 12 so as to turn in unison with the pinion gear 28. Both the pinion gear 28 and the bending disc 27 rotate freely on the fixed axel 12. The fixed axel 12 penetrates the front face of the case 22 and acts as a mounting shaft for various size mandrels. The portion of the fixed axle 12 that protrudes outside the front of the case 22 will be identified as the bend shaft 40.

The bending disc 27 has a force shaft 33 mounted toward the outside edge and perpendicular to its face. Said force shaft travels in a circular cut-out 17 in the face of the case 22. The force shaft 33 is of the same diameter as the bend shaft 40 so as to allow mandrels to be interchanged. The mandrels here forward will be called the force mandrel 16 when installed on the force shaft 33 and the bend mandrel 13 when installed on the bend shaft 40. The force mandrel 13 and the bend mandrel 16 vary in size to accommodate industry standard minimum bend radii. The fixed axel 12 is fixed in position so as not to rotate when the pinion gear 28 and the bending disc 27 rotate.

The force shaft 33 is fixed in position so as not to turn. The force shaft 33 has a shoulder to keep the force mandrel 13 from contacting the face of the case 22 when it is installed. The end of the force shaft 33 is drilled and tapped to accept a retaining bolt 15 and retaining washer 14. The retaining bolt 15 and retaining washer 14 prevent the force mandrel 16 from coming off the force shaft 33. The length of the force shaft 33 is such that when the retaining bolt 15 and the retaining washer 14 is installed and tightened the force mandrel 16 can rotate freely. This allows the force mandrel 16 to roll over the rebar 1 and around the bend mandrel 13 as the machine is working.

Mounted on the face of the case 22 is an adjustable work tray 19 used to position and support the rebar 1 while bending. The work tray 19 has two adjustment pins 35 mounted on the face that contacts the case 12. The adjustment pins 35 are positioned towards the ends of the work tray 19. The case 22 has a series of adjustment holes 34 positioned horizontally so as to line up with the work tray 19 adjustment pins 35. The adjustment holes 34 are positioned vertically at a height on the case 22 so as to allow the work tray 19 to be positioned the proper increment up or down according to the rebar 11 size. The adjustment holes 34 are also positioned vertically at an angle so as to move the work tray 19 horizontally closer to the bend mandrel 13 when smaller sizes are installed thereby keeping a uniform distance between the bend mandrel 13 and the end of the work table 19. The work table 19 is secured to the case 22 with an adjustment bolt 20 and an adjustment knob 37. The adjustment bolt 20 is allowed to travel vertically in an adjustment slot 43 cut in the case 22. The adjustment slot 43 is cut at the same angle as the adjustment holes 34. To adjust the height of the work tray 19 simply loosen the adjustment knob 37 to allow the enough space between the case 22 and the work tray 19 to disengage the adjustment pins 35 from the adjustment holes 34. Position the work tray 19 to the desired level by lining up the adjustment pins 35 with the adjustment holes 34 and tighten the adjustment knob 37.

The bend shaft 40 is drilled and tapped to accept a retaining bolt 15 and retaining washer 14. The purpose of the retaining bolt 15 and retaining washer 14 are to secure the bend mandrel 13 on the bend shaft 40. The length of the bend shaft 40 is slightly shorter than the bend mandrels 13 depth. When the bend mandrels 13 retaining bolt 15 and retaining washer 14 is installed and tightened the bend mandrel 13 will be drawn snuggly against the front of the case 22 thereby preventing it from rotating. This keeps the rebar 11 from rolling forward when bending.

The hydraulic cylinders 23 fluid and pressure is supplied by the skid-steer loader through hydraulic hoses 32 with industry standard quick-connect fittings. When the hydraulic supply hoses 32 are connected to the skid-steer, hydraulic pressure flows through the hydraulic supply hoses 32 to the hydraulic manifold 24. An electric solenoid hydraulic control valve 41 mounted in the hydraulic manifold 24 controls the flow of hydraulic fluid from the hydraulic manifold 24 to the hydraulic cylinder 23. The hydraulic control valve 41 is powered from the skid-steer loaders electric system by connecting the machines power supply cord 39 to the skid-steer loaders power receptacle mounted on the boom.

Actuation of the hydraulic control valve 41 is accomplished by an actuation device such as a foot pedal or a hand selector switch. In an alternate embodiment the hydraulics could be controlled by a manual spool valve. In addition, programmable logic controllers could be incorporated for automation. From here forward we will refer to the actuating device as a control switch 36.

OPERATION

Figure 4:
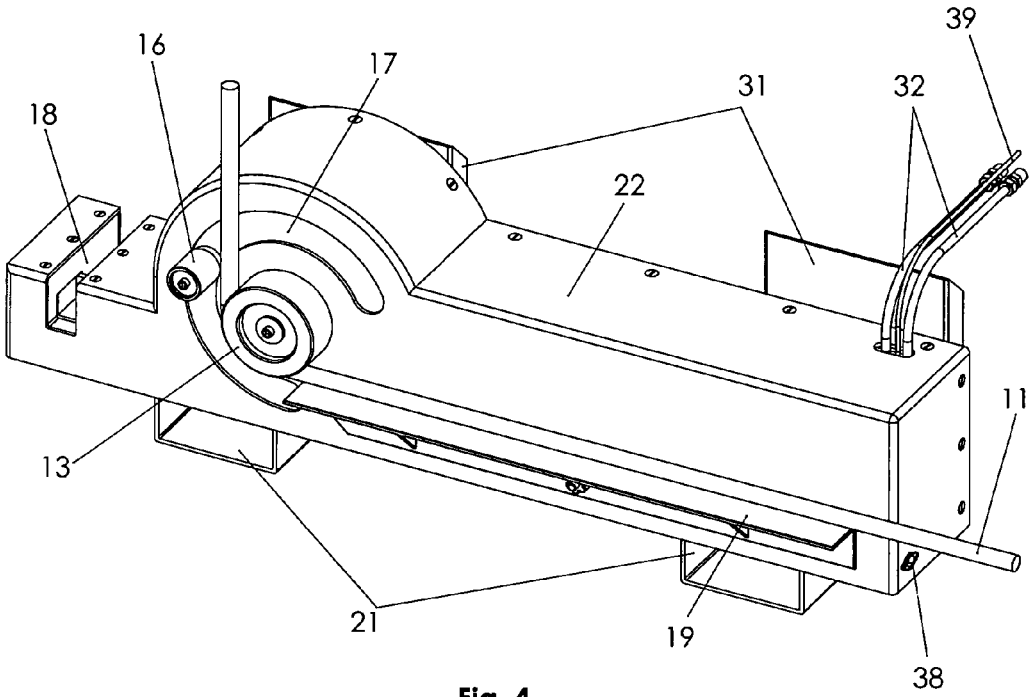
FIG. 4 shows the machine with a piece of rebar positioned on the work tray and bent 90 degrees. The control switch is unplugged and not shown.
Figure 5:
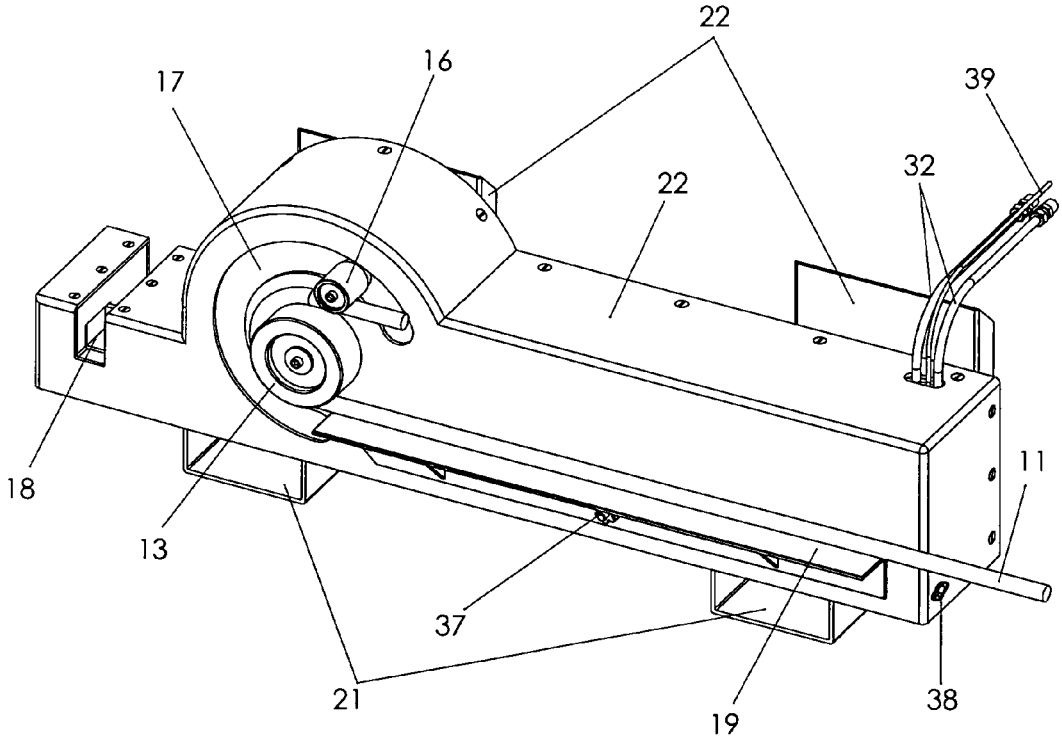
FIG. 5 shows the machine with a piece of rebar positioned on the work tray and bent 180 degrees. The control switch is unplugged and not shown.
Figure 6:
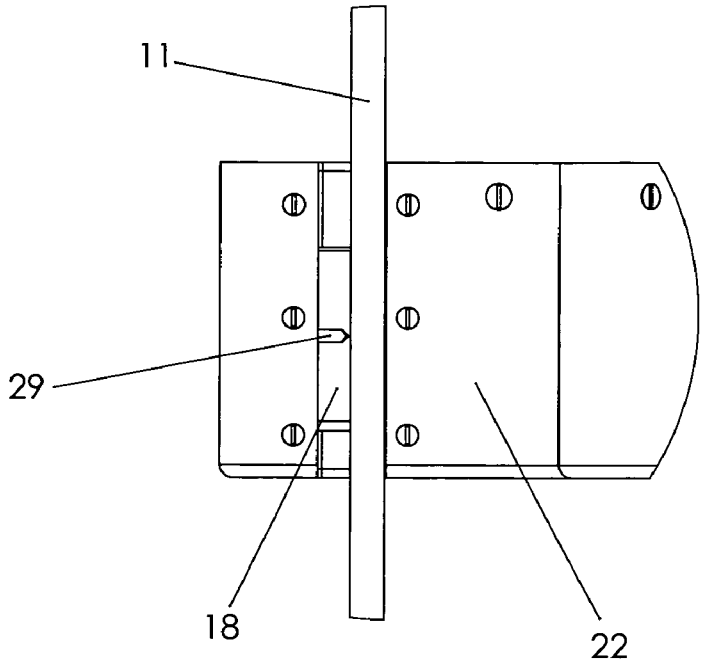
FIG. 6 shows the machine with a piece of rebar inserted in the cutting-zone and ready to be cut.
Figure 7:
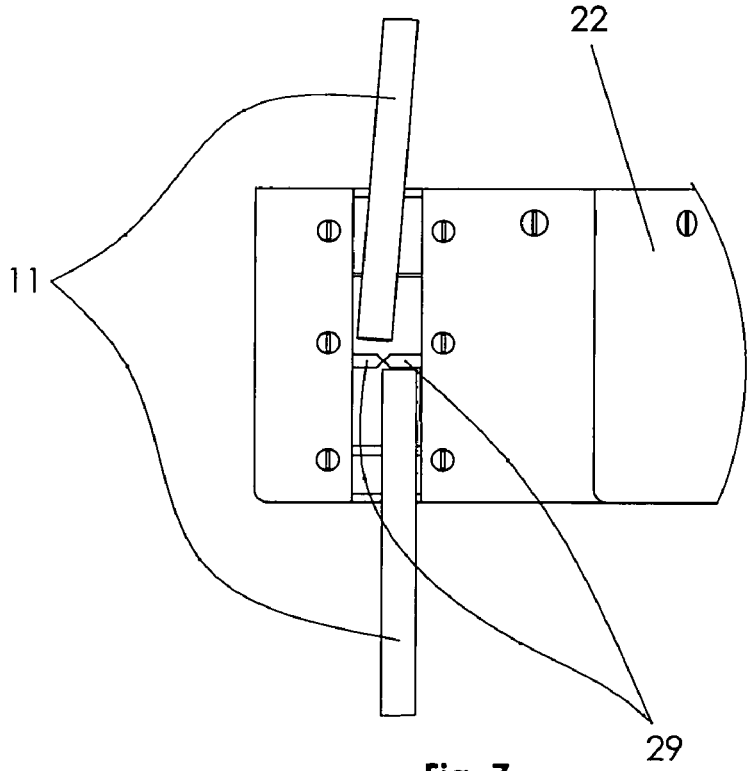
FIG. 7 shows the machine with a piece of rebar inserted in the cutting-zone and cut.

Preferred Embodiment—FIGS. 4, 5, 6, 7, 8, 9

To operate the Hydraulic Bender Cutter machine in the preferred embodiment attach the machine by maneuvering the skid-steer loader so as the loaders mounting plates engage the quick-attach flanges 31 on the back of the machines case 22. Attach the hydraulic supply hoses 32 to the skid-steers hydraulic quick-connect fittings. Raise and tilt the machine to the desired work height and angle.

Install the proper size force mandrel 16 on said force shaft and secure the force mandrel 16 by installing the retaining washer 14 and the retaining bolt 15 in the tapped hole in the force shaft 33. Install the proper size bend mandrel 13 on the bend shaft 40 and secure the bend mandrel 13 by installing the retaining washer 14 and the retaining bolt 15 in the tapped hole in the bend shaft 40.

Adjust the height of the work tray 19 by loosening the adjustment knob 37 to allow enough space between the case 22 and the work tray 19 to disengage the adjustment pins 35 from the adjustment holes 34. Position the work tray 19 to the desired level by lining up the adjustment pins 35 with the adjustment holes 34 and tighten the adjustment knob 37.

Place the rebar 11 on the work tray 19 and position the rebar 11 laterally so that the desired bend point is under the bend mandrel 13. Multiple rebar 11 can be bent simultaneously by stacking the bars flat on the work tray. When ready to bend, activate the control switch 36 in the bend direction. Release the control switch 36 when the bend has reached the desired angle. Return the force mandrel 16 to the start position by activating the control switch 36 in the return direction.

For cutting, with the hydraulic cylinder 23 in the retracted position, simply place the rebar 11 in the cutting zone 18 and activate the control switch 36 as if bending. When the cutter blades 29 meet, the rebar 11 will be cut. To open the cutter blades 29 for another cut, simply activate the control switch 36 in the return direction until the cutting zone 18 is clear.

CONCLUSION, RAMIFICATIONS, AND SCOPE

Accordingly the reader will see that, according to one embodiment of the rebar bender cutter for skid-steer loader, I have provided a simple, durable and reliable rebar bending and cutting attachment. When the rebar bender cutter attachment is installed on a skid-steer loader, it is capable of being positioned as desired around a job site regardless of terrain conditions. Once at the desired work spot the operator can position the rebar bender cutter to the optimum work height and angle for less operator fatigue and greater comfort. In addition, the great weight of the skid-steer loader provides for a very stable work platform.

Because of the machines simple and durable construction it can be stored outside with other typical skid-steer loader attachments requiring less care than other known benders.

While the above description contains many specificities, these should not be construed as limitations on the scope of any embodiment, but as exemplifications of the presently preferred embodiments thereof. Many other ramifications and variations are possible within the teachings of the various embodiments. For example, a hydraulic motor with reduction gearing could be employed rather than a rack and pinion system.

Thus the scope of the invention should be determined by the appended claims and their legal equivalents, and not the examples given.

I claim:

1. A device for preparing a workpiece, the device comprising:

a hydraulic cylinder, the hydraulic cylinder fluidly coupled to a controlled source of hydraulic fluid pressure, the hydraulic cylinder having a ram, the ram moving responsive to the hydraulic fluid pressure;

a linear gear, a first end of the linear gear coupled to the ram;

a pinion gear, teeth of the pinion gear meshed with teeth of the linear gear such that linear motion of the linear gear results in rotational motion of the pinion gear;

a bending member coupled to the pinion gear, the bending member rotating responsive to the rotational motion of the pinion gear;

a bending mandrel mounted on a face of the bending member at a center of rotation of the bending member;

a force mandrel mounted on the face of the bending member;

a means for actuating the hydraulic fluid pressure;

a means for attaching the device for preparing the workpiece to a boom of a skid-steer loader;

wherein the hydraulic cylinder, the linear gear and the pinion gear are mounted within a case and an outside surface of the case has the means for attaching the device for preparing the workpiece to the boom of the skid-steer loader.

2. The device for preparing of claim 1, wherein the means for attaching the device for preparing the workpiece to the boom of the skid-steer loader comprises one or more industry standard quick attach flanges.

3. The device for preparing of claim 1, wherein the means for actuating the hydraulic fluid pressure provides fluid pressure to the hydraulic cylinder in a first direction thereby rotating the bending member in a first rotational direction and provides fluid pressure to the hydraulic cylinder in an opposite direction thereby rotating the bending member in an opposite rotational direction.

4. The device for preparing of claim 1, whereas placement of a bendable object between the bending mandrel and the force mandrel and actuating the hydraulic fluid pressure to provide fluid pressure to the hydraulic cylinder in the first direction results in the force mandrel orbiting around the bending mandrel, thereby bending the bendable object.

5. The device for preparing of claim 1, wherein the bendable object is rebar.

6. The device for preparing of claim 1, further comprising a cutting edge interfaced with the linear gear and a stationary cutting edge interfaced to the case, the cutting edge applying a cutting force against an object placed between the cutting edge and the stationary cutting edge responsive to linear motion of the linear gear.

7. A device for preparing a workpiece, the device comprising:

a case;

a hydraulic center, a means for converting hydraulic pressure into a rotational force of a bending member, the rotational force controlled by a means for actuating, the means for converting hydraulic pressure into a rotational force mounted within the case;

a bending mandrel mounted on a face of the bending member at a center of rotation of the bending member;

a force mandrel mounted on the face of the bending member;

a means for attaching the device for preparing the workpiece to a boom of a skid-steer loader; and a means for cutting the plastically deformable material of elongated shape, the means for cutting interfaced with the means for converting hydraulic pressure into a rotational force;

whereas placement of a plastically deformable material of elongated shape between the bending mandrel and the force mandrel and actuation of the means for actuating results in rotation of the bending member and bending of the plastically deformable material of elongated shape.

8. The device for preparing of claim 7, wherein the means for attaching the device for preparing the workpiece to the boom of the skid-steer loader comprises one or more industry standard quick attach flanges.

9. The device for preparing of claim 7, wherein the means for actuating the hydraulic fluid pressure provides fluid pressure to the means for converting hydraulic pressure into the rotational force in a first direction thereby rotating the bending member in a first rotational direction and the means for actuating the hydraulic fluid pressure provides fluid pressure to the means for converting hydraulic pressure into the rotational force in the opposite direction thereby rotating the bending member in an opposite rotational direction.

10. The device for preparing of claim 9, whereas placement of the plastically deformable material of elongated shape between the bending mandrel and the force mandrel and actuating the means for actuating to provide fluid pressure to the hydraulic cylinder in the first direction results in the force mandrel orbiting around the bending mandrel, thereby bending the plastically deformable material of elongated shape.

11. The device for preparing of claim 10, wherein the plastically deformable material of elongated shape is rebar.

12. A device for preparing a workpiece, the device comprising:

a case;

hydraulic supply hoses, the hydraulic supply hoses for connecting to a skid-steer loader through an industry standard quick-connect interface;

a hydraulic cylinder mounted within the case, the hydraulic cylinder having a ram;

a hydraulic control valve, the hydraulic control valve adapted to receive hydraulic pressure from the skid-steer loader through the hydraulic supply hoses, the hydraulic control valve manually controllable in at least two modes;

a linear gear slideably interfaced within the case, a first end of the linear gear coupled to the ram;

a pinion gear rotatably interfaced within the case, teeth of the pinion gear meshed with teeth of the linear gear such that linear motion of the linear gear results in rotational motion of the pinion gear;

a bending member coupled to the pinion gear, the bending member rotating responsive to rotation of the pinion gear;

a bending mandrel mounted on a face of the bending member at a center of rotation of the bending member; and a force mandrel mounted on the face of the bending member;

whereas the case has at least one quick attach flange on an outer surface of the case, the quick attach flange for attaching the case to a boom of the skid-steer loader.

13. The device for preparing of claim 12, wherein the hydraulic control valve provides fluid pressure to the hydraulic cylinder in a first direction thereby rotating the bending member in a first rotational direction and provides fluid pressure to the hydraulic cylinder in an opposite direction thereby rotating the bending member in an opposite rotational direction.

14. The device for preparing of claim 12, wherein the bending member is a bending disc.

15. The device for preparing of claim 14, wherein the plastically deformable material of elongated shape is rebar.

16. The device for preparing of claim 12, further comprising a cutting edge interfaced with the linear gear and a stationary cutting surface interfaced to the case, the cutting edge applying a force against an object placed between the stationary cutting surface and the cutting edge responsive to linear motion of the linear gear.

17. The device for preparing of claim 12, wherein the mandrel and the force mandrel are removably attached to the bending member.

18. The device for preparing of claim 12, wherein the linear gear is slideably interfaced within the case within a slide channel, the slide channel affixed to an inside surface of the case.

* * * * *